US008347415B2

(12) United States Patent
Mazzarolo

(10) Patent No.: US 8,347,415 B2
(45) Date of Patent: Jan. 8, 2013

(54) SPORT GARMENT HAVING AN IMPROVED COMFORTABLENESS

(75) Inventor: Giovanni Mazzarolo, Coste di Maser (IT)

(73) Assignee: Alpinestars Research SRL, Coste di Maser (IT)

( * ) Notice: Subject to any disclaimer, the term of this patent is extended or adjusted under 35 U.S.C. 154(b) by 680 days.

(21) Appl. No.: 12/066,568

(22) PCT Filed: Sep. 13, 2005

(86) PCT No.: PCT/IT2005/000520

§ 371 (c)(1),
(2), (4) Date: Mar. 12, 2008

(87) PCT Pub. No.: WO2007/032031

PCT Pub. Date: Mar. 22, 2007

(65) Prior Publication Data

US 2008/0250551 A1 Oct. 16, 2008

(51) Int. Cl.
*A41D 1/06* (2006.01)

(52) U.S. Cl. ..... 2/227

(58) Field of Classification Search ..... 2/22–24, 2/79, 227, 69, 455, 267, 62, 242, 911
See application file for complete search history.

(56) References Cited

U.S. PATENT DOCUMENTS

| | | | |
|---|---|---|---|
| 1,660,342 | A | 2/1928 | Levinson |
| 3,086,214 | A | 4/1963 | Lash |
| 3,329,966 | A | 7/1967 | Slavick |
| 3,843,969 | A | 10/1974 | George et al. |
| 3,878,561 | A | 4/1975 | Winiecki |
| 4,608,716 | A | 9/1986 | Brumfield |
| 4,700,407 | A | 10/1987 | Mattila |
| 4,722,099 | A | 2/1988 | Kratz |
| 4,773,100 | A | 9/1988 | Kuo |
| 4,810,559 | A | 3/1989 | Fortier et al. |
| 4,841,577 | A | 6/1989 | Lars-Jos |
| 4,845,778 | A | 7/1989 | Peterson |
| 4,946,453 | A | 8/1990 | Monson |

(Continued)

FOREIGN PATENT DOCUMENTS

| | | |
|---|---|---|
| CN | 2643684 | 9/2004 |

(Continued)

OTHER PUBLICATIONS

Chinese Office Action dated Apr. 24, 2009, from the corresponding Chinese Application.

(Continued)

*Primary Examiner* — Tejash Patel
(74) *Attorney, Agent, or Firm* — Katten Muchin Rosenman LLP

(57) ABSTRACT

A garment for sport activities prevailingly made of substantially inextensible materials comprises additional flaps (140) of extensible elastic materials supplementing the conventional stretchable inserts (130). When the wearer of the garment is of anormal anatomic typology, the supplementary flaps (140) are concealed inside the garment but are adapted to be freely exposed on the garment outer surface by a manual actuation of zippers (135) in case of a different anatomic typology. Each additional flap (140) is attached at a first lateral side (136) to an insert (130) and at the opposite lateral side (137) to a zone of the garment which is made of substantially inextensible materials. Thus, the garment fits adequately and comfortably to the wearer's body also in correspondence of parts of the body which can be of various shapes and/or dimensions.

6 Claims, 2 Drawing Sheets

U.S. PATENT DOCUMENTS

| | | | | |
|---|---|---|---|---|
| 4,953,856 | A | 9/1990 | Fox, III | |
| 5,038,408 | A | 8/1991 | DeBaene | |
| 5,052,052 | A | 10/1991 | Gilford et al. | |
| 5,109,546 | A | 5/1992 | Dicker | |
| 5,201,074 | A | 4/1993 | Dicker | |
| 5,282,277 | A | 2/1994 | Onozawa | |
| 5,295,267 | A | 3/1994 | Galindo | |
| 5,337,418 | A | 8/1994 | Kato et al. | |
| 5,367,708 | A | 11/1994 | Fujimoto | |
| 5,649,328 | A | 7/1997 | Martin | |
| 5,652,957 | A | 8/1997 | Williford et al. | |
| 5,737,772 | A | 4/1998 | Dicker et al. | |
| 5,737,773 | A | 4/1998 | Dicker et al. | |
| 5,768,703 | A | 6/1998 | Machado et al. | |
| 5,845,335 | A | 12/1998 | Twitty | |
| 5,845,336 | A | 12/1998 | Golde | |
| 5,898,934 | A | 5/1999 | Hunter et al. | |
| 5,960,474 | A | 10/1999 | Dicker et al. | |
| 5,978,966 | A | 11/1999 | Dicker et al. | |
| 6,053,852 | A | 4/2000 | Wilkinson | |
| 6,176,816 | B1 | 1/2001 | Dicker et al. | |
| 6,186,970 | B1 | 2/2001 | Fujii et al. | |
| 6,260,196 | B1 | 7/2001 | van der Sleesen | |
| 6,279,161 | B1 | 8/2001 | Johnston | |
| 6,519,781 | B1 | 2/2003 | Berns | |
| D481,523 | S | 11/2003 | Hujii et al. | |
| 6,708,342 | B2 | 3/2004 | Boersema | |
| 6,817,029 | B2 | 11/2004 | Mazzarolo | |
| 6,854,130 | B2 * | 2/2005 | van der Sleesen | 2/69 |
| 7,117,537 | B2 | 10/2006 | Mazzarolo | |
| 7,229,390 | B2 | 6/2007 | Fujii et al. | |
| 7,516,498 | B2 | 4/2009 | Torry | |
| 2001/0014981 | A1 | 8/2001 | Fairhurst et al. | |
| 2002/0138893 | A1 | 10/2002 | Culhane | |
| 2003/0140404 | A1 | 7/2003 | Golde | |
| 2004/0025217 | A1 | 2/2004 | Mazzarolo | |
| 2004/0255358 | A1 | 12/2004 | Ota et al. | |

FOREIGN PATENT DOCUMENTS

| | | | |
|---|---|---|---|
| DE | 30 33 059 | | 4/1982 |
| DE | 37 31 878 | | 1/1989 |
| DE | 39 00 694 | | 7/1990 |
| DE | 9101718 | U1 | 5/1991 |
| DE | 41 42 279 | | 11/1992 |
| DE | 195 27 037 | | 1/1997 |
| DE | 29709132 | U1 | 7/1997 |
| DE | 199 20 562 | | 11/2000 |
| DE | 100 17 792 | | 10/2001 |
| EP | 0 118 898 | | 9/1984 |
| EP | 0 950 360 | | 10/1999 |
| FR | 1220511 | A | 5/1960 |
| FR | 2 449 415 | | 9/1980 |
| FR | 2 476 453 | | 8/1981 |
| FR | 2 665 060 | | 1/1992 |
| GB | 171 258 | | 11/1921 |
| GB | 2 043 430 | | 10/1980 |
| WO | 01/10254 | | 2/2001 |
| WO | 2004039189 | A | 5/2004 |

OTHER PUBLICATIONS

International Search Report and Written Opinion dated Jun. 28, 2006 from corresponding PCT/IT05/000520.
International Search Report dated Mar. 12, 2004, from corresponding International Application No. PCT/EP03/11991.
International Preliminary Examination Report dated Jan. 17, 2005, from corresponding International Application No. PCT/EP03/11991.
United States Office Action dated Mar. 2, 2006, from corresponding U.S. Appl. No. 11/116,126.
United States Office Action dated Feb. 21, 2007, from corresponding U.S. Appl. No. 11/116,126.
United States Office Action dated May 19, 2009, from corresponding U.S. Appl. No. 11/116,126.
United States Office Action dated Dec. 1, 2004, from corresponding U.S. Appl. No. 10/399,347.
United States Office Action dated May 18, 2005, from corresponding U.S. Appl. No. 10/399,347.
United States Office Action dated Feb. 22, 2006, from corresponding U.S. Appl. No. 10/399,347.
United States Office Action dated Feb. 23, 2004, from corresponding U.S. Appl. No. 10/415,624.
International Search Report dated Sep. 9, 2005, from corresponding International Application No. PCT/EP2004/013095.
Written Opinion of the International Searching Authority, from corresponding International Application No. PCT/EP2004/013095.

* cited by examiner 112
131
130
134A
135
137
140
138
134A
136
133
132

112
131
130
134A
140
138
135
137
134B
133
136
132

112
131
130
134A
138
135
137
134B
136
133
132

SPORT GARMENT HAVING AN IMPROVED COMFORTABLENESS

FIELD OF THE INVENTION

The present invention refers to garments utilized in different sport activities which should fit about the wearers' bodies. Motociclists suits (where a vest is inseparably joined to a pair of trousers extended downward up to the wearers' ankles), particularly those used by pilots during high speed races, are one typical, though not unique, example of such garments which is described here below.

STATE OF ART

In spite of the various sizes and variants offered for sale to the potential customers, it is almost impossible that the motorcyclists' suits fit tightly (so as to not affect their aerodynamic features) about any zone of the bodies without annoying in any manner the wearers.

This is due not only to the fact that the various zones of wearers' bodies, in particular the limbs, are extremely variable in shape and dimensions but also to the fact that that bodies are inevitably subject to frequent variations of posture while the suit's wearers are performing their sport activity. In both cases, the leather of which many parts of the suits are made, not to mention the protective parts which are made of tough materials like metal or carbon fibers, can easily cause some annoyance to the wearers.

The simple utilization of stretch fabrics, namely elastic materials, to make inserts comprised in the suits' construction is well known in the art—for example as disclosed in the patent specification WO-A-2004 039189 of the same Applicant—proved effective in respect of many aspects but not to eliminate the inconveniences due to by the big variability in the shape and dimensions of wearers' limbs, particularly in correspondence of the calves.

OBJECTS AND ESSENCE OF THE INVENTION

Accordingly, it is a main object of the present invention an improved construction of said garments for sport activities which are prevailingly made with leather or other substantially inextensible materials, the improvements being of a nature ensuring an optimum fitness about all zones of the wearers' bodies, particularly in correspondence of the calves, independently from their big variability in shape and dimensions.

Another object of the invention is to not make more complex, and preferably to simplify the mass production of the garments with a possible reduction of the different the sizes with which the garments are offered for sale.

These and other objects are attained by a garment for sport activities, such as for example a suit for motorcyclists, comprising a pair of long trousers having a manually enlargeable stretchable insert in correspondence of each calf and other characterizing features according to the appended claims.

BRIEF DESCRIPTION OF THE DRAWINGS

A preferred though not exclusive embodiment of a garment for sport activities will now be described for a better understanding of the invention and its advantages. Once again it is confirmed that the description of a suit for motorcyclists is a mere example and not a limitation of the field of the invention.

In the herewith enclosed drawing.

DETAILED DESCRIPTION OF A PREFERRED EMBODIMENT

Figure 1:
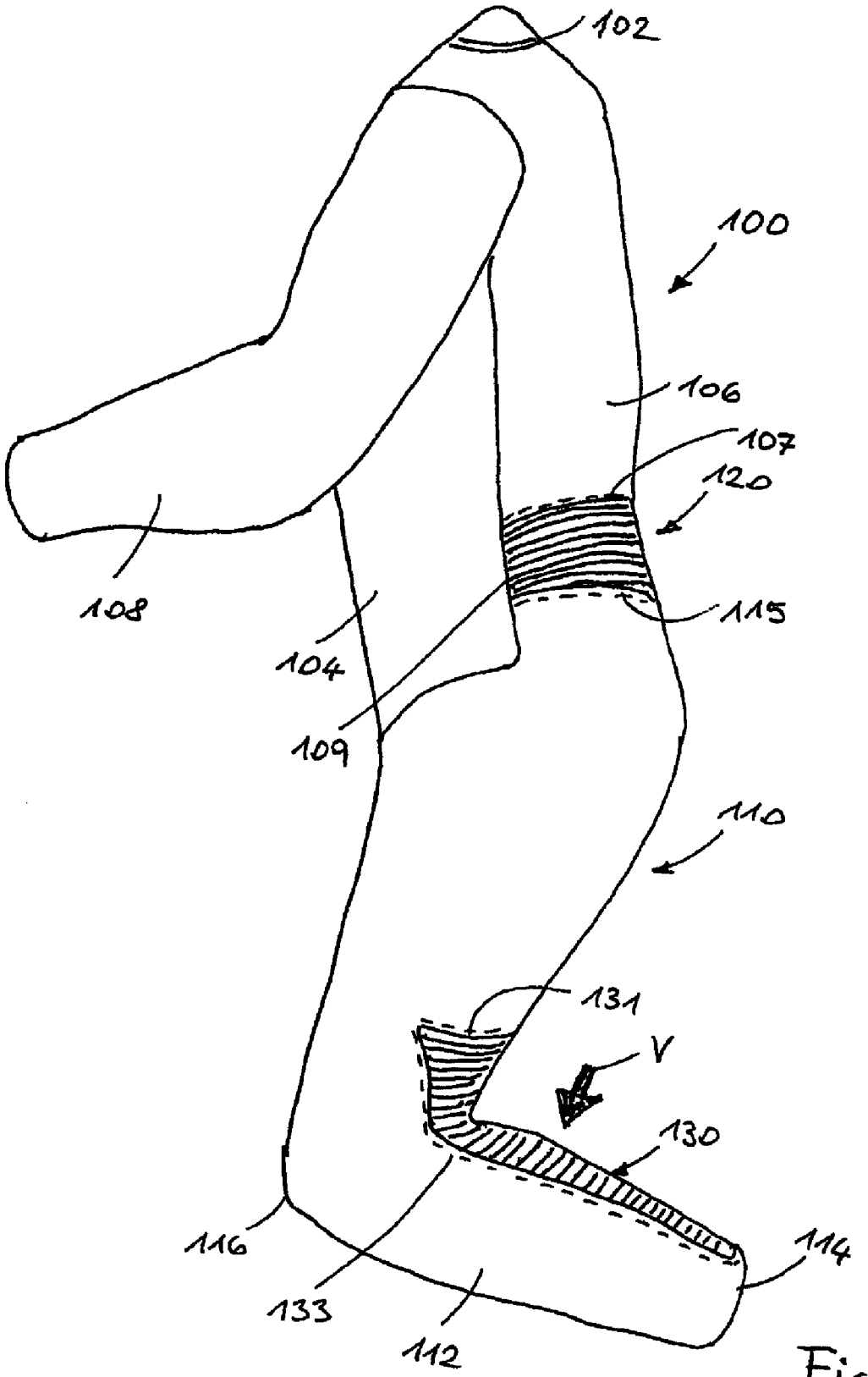
FIG. 1 is an overall simplified lateral view of a suit for motorcyclists incorporating the invention.

The lateral view of FIG. 1 shows schematically a suit for motorcyclists which, in a well known manner, is a garment comprising an upper part in form of a vest 100 and a lower part in form of a pair of long trousers 110, which are inseparably joined to one another by a stretchable belt 120 restricted to the rear zone of the suit. Both parts 100, 110 are prevailingly made of leather and/or other substantially inextensible materials and are commonly provided with protective parts, for example in correspondence of shoulders, elbows and knees. These parts, per se well known in the art and made of rigid and/or abrasion resistant materials, are not shown since they do not affect the present invention.

The vest 100 includes a collar 102, a pair of front flaps (of which only one, identified by reference numeral 104, is visible), closable by a zipper (not visible), a rear flap 106 and a pair of sleeves (of which only one, identified by reference numeral 108, is visible). The lower apertures 114 at the bottom end of the trousers' legs (of which only one, identified by reference numeral 112, is visible) are in correspondence of the wearer's ankles.

As already briefly mentioned, the belt 120 is made of stretch elastic material and arranged in correspondence of the waist of the suit. Three sewing seams, namely one substantially horizontal identified by reference numeral 107 and two vertical (of which only one, identified by reference numeral 109, is visible) are used to attach the belt 120 to the vest 100 while another substantially horizontal sewing seam 115 is used to attach the belt 120 to the trousers 110.

According to the invention, in the region of the calves, namely in the rear zone comprised between the lower apertures 114 and the knees 116, each leg 112 of the trousers 110 has an insert 130 made of stretchable elastic textile material.

Figures 2, 3, 4:
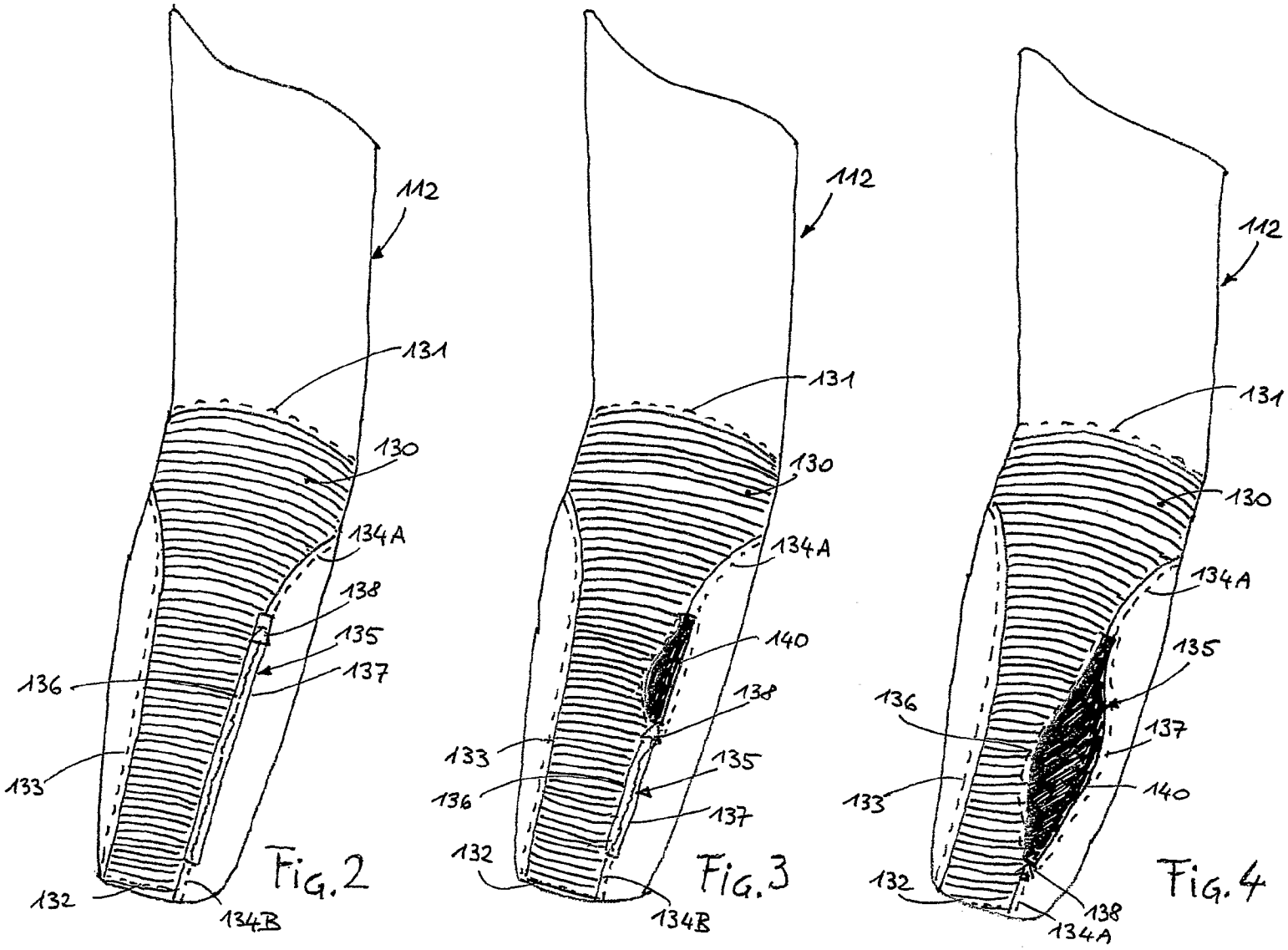
FIG. 2 is a partial view of the calf region of a leg of this suit, as seen from the direction of arrow V in FIG. 1, the view showing a first configuration of the invention.
FIG. 3 is a view similar to FIG. 2 showing a second configuration of the invention.
FIG. 4 is a view similar to FIGS. 2 and 3 showing a third configuration of the invention.

From FIGS. 2-4 it can be seen that the stretchable insert 130 is of an elongated shape like the calf and attached at its periphery to the portion made of leather of the trousers' leg 112. To this purpose, a first transversal sewing seam 131 is arranged just above the knee 116, a second sewing transversal seam 132 close to the lower apertures 114 at the bottom end of the trousers and a third longitudinal sewing seam 133 along the outer side of the calf. Up to this point of the description the suit is of a fully conventional construction and further details are not necessary.

According to a main feature of the present invention, two short sewing seams 134A, 134B and a zipper 135 are, provided to attach the stretchable insert 130 along the inner side of the calf, namely opposite to said third sewing seam 133. The zipper 135 is of the semi auto lock-type (for example YKK no. 3 Semi Auto Lock Zipper CFC39 DS5YG C5P12) and arranged between the upper short seam 134A and the lower short seam 134B so as to normally conceal an additional flap 140. For a better clarity, the said flap 140 (which is only visible in FIGS. 3 and 4) is of a black colour in the attached drawing. The flap 140 is a rectangular strip of textile stretchable material (which is preferably, of a lower thickness than insert 130) arranged in the interior of the trousers' leg 112. The flap 140 has its longer opposite sides attached by sewing seams to the two textile ribbons 136 and 137 bearing the rows of teeth of the zipper 135 and the sliding element 138 readily accessible by the wearer of the suit. The first ribbon 136 of the zipper 135 is in turn attached to the stretchable insert 130 along the side of the calf opposite to said third sewing seam 133, while the second ribbon 137 of the zipper 135 is in turn attached to the bottom part made of leather of the trousers' leg 112.

FIGS. 2-4 show three configurations of the trousers' legs 112 corresponding to three different anatomic typologies of the wearer's calves.

The configuration shown in FIG. 2 corresponds to a suit worn by a person having a pair of calves of such a shape and dimensions that the extensibility of the inserts 130 is sufficient to ensure that the trousers 110 fit adequately and comfortably about his/her, legs, so that the zippers 135 are fully locked and their sliding elements 138 in their raised positions, namely close to the bottom ends of the upper stitching seams 134A. In this configuration, which is the normal case, the additional flaps 140 are wholly concealed inside the trousers' legs 112.

The configuration shown in FIG. 3 corresponds to a wearer having a pair of calves of a bigger shape and dimensions than the wearer corresponding to FIG. 2, so that the extensibility of the inserts 130 is not sufficient to ensure that the trousers 110 fit comfortably about his/her legs. In this case, according to the present invention, an use is made of the additional flap 140 by making it partially exposed at the rear outer surface of the trousers' legs 112. In fact, it suffices for the wearer to partially unlock the zippers 130 through a downwards actuation of the sliding elements 138 up to a point which is quite clearly selectable in a free manner by each individual wearer according to his/her anatomic typology. In the selected point the zipper 135 is again locked and, thanks to the partial extensibility of the additional flaps 140 in addition to the entire extensibility of the inserts 130, the trousers 110 will fit adequately and comfortably about the wearer's legs. Thanks to the use of a zipper of the semi-automatic lock type, the configuration remains unchanged until it is time for the wearer to undress.

The configuration shown in FIG. 4 corresponds to a wearer having a pair of calves of a truly big shape and dimensions, so that not even the configuration of shown in FIG. 3 can ensure that the trousers 110 fit comfortably about his/her legs. In this case, according to the present invention, the extensibility of the additional flap 140 is used in its entirety by making it fully exposed at the rear surface of the trousers' legs 112. In fact, it suffices for the wearer to unlock the zippers 130 through a downwards actuation of the sliding elements 138 which terminates in their lowermost positions, namely close to the upper ends of the bottom stitching seams 134B. In those positions, thanks to the entire extensibility of the inserts 130 and of the additional flaps 140, the trousers 110 will fit adequately and comfortably about the wearer's legs.

Even if the preceding description refers to the use of additional flaps made of stretchable elastic materials which are used for a better fit of the suit in correspondence of the calves of an user, the present invention is also usable on the upper limbs (arms) and even of the breast of a suit for motorcyclist or any other garment with similar requirements.

The advantages of the present invention, which are easily derived from the preceding description, can be briefly summarized as follows:

a) independently of its overall shape and dimensions, the wearer's body is adequately and comfortably fit about by the garment;

b) for the manufacturer it is possible to reduce the total number of sizes and variants made available for sale, provided that a wider variety of wearers' bodies can be satisfied by the same size in a range of garments.

Other embodiment and variants of the present invention are envisaged within the field of the appended claims, for example the replacement of the zippers 135 by other adjustable closure means, like series of buttons, in particular stud buttons.

The invention claimed is:

1. A garment for sports activities, the garment comprising:

a substantially inextensible material;

a plurality of inserts for accommodating various shapes and dimensions of a body of a wearer, the plurality of inserts comprising a stretchable elastic material;

a flap supplementing a first insert of the plurality of inserts, the flap comprising a stretchable textile material; and an adjustable closure means having a first side connected to the first insert and a second side connected to the substantially inextensible material;

wherein the flap has a first side connected to the first side of the adjustable closure means and a second side connected to the second side of the adjustable closure means;

wherein the flap in a first state, when the adjustable closure means are fully closed, is normally concealed inside the garment and is in an unextended condition, and in a second state, when the adjustable closure means are at least partially opened through the manual actuation by the wearer, is exposed at an outer surface of the garment, the flap is an at least partially extended condition.

2. Garment for sport activities according to claim 1, further comprising a vest inseparably joined to a pair of trousers with long legs to constitute a suit wherein the garment is provided with said inserts supplemented by the additional flap in correspondence of a lower limb of the wearer.

3. A garment for sports activities, the garment comprising:

a substantially inextensible material forming a vest and a pair of trousers having long legs;

a plurality of inserts for accommodating various shapes and dimensions of a body of a wearer, the plurality of inserts comprising a stretchable elastic material;

a plurality of flaps supplementing the plurality of inserts, each of the flaps comprising a stretchable textile material; and an adjustable closure means having a first side connected to the first insert and a second side connected to the substantially inextensible material;

wherein each of the flaps has a first side connected to the first side of the adjustable closure means and a second side connected to the second side of the adjustable closure means;

wherein the flap in a first state, when the adjustable closure means are fully closed, is normally concealed inside the garment and is in an unextended condition, and in a second state, when the adjustable closure means are at least partially opened through the manual actuation by the wearer, is exposed at an outer surface of the garment, the flap is an at least partially extended condition; and wherein another of the plurality of flaps another of the plurality of inserts are disposed in correspondence with an arm of the wearer.

4. A garment for sports activities, the garment comprising:

a substantially inextensible material forming a vest and a pair of trousers having long legs;

a plurality of inserts for accommodating various shapes and dimensions of a body of a wearer, the plurality of inserts comprising a stretchable elastic material;

a plurality of flaps supplementing the plurality of inserts, each of the flaps comprising a stretchable textile material; and an adjustable closure means having a first side connected to the first insert and a second side connected to the substantially inextensible material;

wherein each of the flaps has a first side connected to the first side of the adjustable closure means and a second side connected to the second side of the adjustable closure means;

wherein the flap in a first state, when the adjustable closure means are fully closed, is normally concealed inside the garment and is in an unextended condition, and in a second state, when the adjustable closure means are at least partially opened through the manual actuation by the wearer, is exposed at an outer surface of the garment, the flap is an at least partially extended condition; and wherein one of the plurality of flaps and one of the plurality of inserts are disposed in correspondence with a chest of the wearer.

5. Garment for sport activities according to claim 1, characterized in that the garment is provided with said inserts (130) supplemented by additional flaps (140) in correspondence of the calves of the wearer.

6. Garment for sport activities according to claim 1, characterized in that the adjustable closure means (135) of said additional flaps (140) are zippers (135) so that the first side (136) at which each additional flap (140) is attached to the associated stretchable insert (130) and the second side (137) at which the flap (140) is attached to a part (112) of the garment made of substantially inextensible materials, consist in the two textile ribbons bearing the two rows of teeth of said zipper (135).

* * * * *